US007026558B1

(12) United States Patent
Andreyo

(10) Patent No.: US 7,026,558 B1
(45) Date of Patent: Apr. 11, 2006

(54) MOTOR OPERATOR, WITH INHERENT DECOUPLING CHARACTERISTICS, FOR ELECTRICAL POWER SWITCHES

(75) Inventor: Joseph K. Andreyo, North Huntingdon, PA (US)

(73) Assignee: Cleaveland/Price Inc., Trafford, PA (US)

( * ) Notice: Subject to any disclaimer, the term of this patent is extended or adjusted under 35 U.S.C. 154(b) by 91 days.

(21) Appl. No.: 10/752,727

(22) Filed: Jan. 7, 2004

(51) Int. Cl.
*H01H 3/20* (2006.01)

(52) U.S. Cl. ..... 200/17 R; 200/50.32; 200/48 R; 200/331

(58) Field of Classification Search ..... 200/17 R, 200/18, 50.32, 50.37, 48 R–48 CB, 330, 200/331; 218/153, 154
See application file for complete search history.

(56) References Cited

U.S. PATENT DOCUMENTS 3,508,179 A * 4/1970 Evans et al. ..... 335/68
3,980,977 A 9/1976 Evans
5,091,616 A 2/1992 Ramos et al.
5,769,208 A * 6/1998 Griffith ..... 200/48 R
5,856,642 A 1/1999 Sanders
5,895,987 A 4/1999 Lo et al.
6,025,657 A 2/2000 Lo et al.
6,072,142 A * 6/2000 Linder et al. ..... 218/154
6,818,846 B1 * 11/2004 Roberts ..... 200/331

OTHER PUBLICATIONS

Cleaveland/Price Inc., Bulletin DB-128CO1 (pub'd. 2001), "Motor Operators for Transmissionand Distribution Automation".

* cited by examiner

*Primary Examiner*—Michael A. Friedhofer
(74) *Attorney, Agent, or Firm*—Gordon H. Telfer

(57) ABSTRACT

A motor of a power switch motor operator has its motor shaft coupled to the output member of the operator, that connects with the power switch, through a drive assembly with at least one drive element continuously linked to the motor shaft, but not to the output member, and at least another drive element continuously linked to the output member, but not to the motor shaft. Temporary engagement of the mentioned drive elements, with motor operation of the power switch, is effected by temporary force transfer parts on the drive elements (e.g., a fixed post on one engaging a spring-loaded cam bar on the other) which inherently disengage following force transfer sufficient to operate the switch. The inherently decoupled state allows immediate straightforward manual operation by an operating member, even when the motor operator is at an overhead switch location, without any turning of the motor or engaging of the temporary force transfer parts during the manual operation.

23 Claims, 4 Drawing Sheets

MOTOR OPERATOR, WITH INHERENT DECOUPLING CHARACTERISTICS, FOR ELECTRICAL POWER SWITCHES

BACKGROUND OF THE INVENTION

1. Field of the Invention

The invention relates generally to electrical power switchgear with motor operators and, more particularly, to motor operators for power switches with a drive system that facilitates switch operation by force other than from the motor of the operator, such as manually applied force, even for switches at overhead (or pole-top) locations.

2. Background Art

Motor operators are widely used in combination with power switches. A variety of operators are in use with various features to permit a switch operation to be performed manually. These have included operators with features for mechanically decoupling the operator's drive system from the motor. Decoupling has taken a number of different forms.

Power switches are applied at a variety of locations including some at surface, or ground level, locations relatively easily accessed for manual decoupling and switch operation and some at overhead (or pole-top) locations less easily accessed.

For example, some overhead switches have a motor operator at or near ground level with a mechanical (reciprocating or torsional) link to a switch drive at the overhead location that may be forty or fifty feet higher. Such an operator is, for example, described in Cleaveland/Price Inc., Bulletin DB-128C01 of 2001. The motor operator is housed in an enclosure also containing other power, control and protection elements, including elements for initiating operation from a remote control station. To perform a manual switch operation with that system, a worker removes a hand tool (e.g., a hand crank) from the enclosure whose removal opens a handle interlock switch that in turn opens the motor control circuit so the motor will not operate during manual operation. A decoupler pin, or other mechanical release element, is available for manual removal so a manual switch operation can be performed using the hand tool to apply force to move the mechanical linkage to the overhead switch without requiring manual turning of the motor. When manual operations are completed, replacement of the hand tool and the decoupler pin restores the system for operation by the motor.

Such systems have been quite successful. Recently, however, some interest has developed in equipping overhead switches with motor operators at the pole-top location with only a short mechanical link to the switch. This can, for example, lessen any concerns about dimensional variance of the mechanical linkage over the long life of an installation, minimize ground equipment subject to safety or vandalism concerns, and provide an overall cleaner, uncluttered look to an installation (even though some power supply and control elements can be housed at a surface location, preferably of course well secured in a locked enclosure). While such operators may be similar to the former ground-based units in some respects, e.g., including remotely initiated power operation, if the same features for manual operation are retained there is the problem of accessing the manual elements, such as requiring a worker to climb up to the operator, or use of a lift-truck, which is expensive and troublesome.

Among other prior art of switch motor operators with some kind of decoupling for manual operation, whether or not for overhead installations, are those contained in the following U.S. patents (which are merely partially and briefly described).

Evans U.S. Pat. No. 3,980,977, Sep. 14, 1976, illustrates a system in which insertion of a specified hand tool at a particular location of a clutch mechanism in a motor operator disconnects the motor from the mechanism and allows manual rotation of a drive lever that recharges a wound spring operating mechanism.

Ramos et al. U.S. Pat. No. 5,091,616, Feb. 25, 1992, shows a pole-top motor operator and specially designed switch combination with a disconnect linkage manually operable by a hook stick or the like that moves switch-pole housings of the switch.

Sanders U.S. Pat. No. 5,856,642, Jan. 5, 1999, discloses an infinite engagement friction clutch coupled switch operator with selectable engagement and disengagement by a user to allow for manual operation.

Lo et al. U.S. Pat. No. 5,895,987, Apr. 20, 1999, and U.S. Pat. No. 6,025,657, Feb. 15, 2000, present a switchgear motor operator with a drive including a clutch with a hub and friction discs or an actuator-follower arrangement with opposing actuating and follower surfaces that is subject to an automated control means that responds to a switch operation to reverse the engaging elements to allow manual operation.

Such known art, however useful each may be and with whatever varied tradeoffs each carries with it in terms of high or low cost, convenience, complexity, and susceptibility to inoperability due to a loss of power or functionality, all has a common characteristic in that each necessitates performing an explicit decoupling process, in addition to the merely normal switch opening and closing of a motor operator, either manually or motor driven and either specifically initiated when desired or automatically by a control system.

SUMMARY OF THE INVENTION

In part, the present invention resides in a motor operator with a motor shaft coupled to an operator output, attachable to a switch, by a drive assembly that has elements with mutual engagement (coupling) temporarily during a period of force application to the output sufficient for switch operation followed, without any required manual or power intervention, by disengaging (decoupling). In this respect, the apparatus of the invention exhibits decoupling as an inherent part of its operation. It does not require a positive act to be performed, following a switch operation, to decouple manually or under power, including what some might regard as "automatic" decoupling in which a control system senses an operation and, without human intervention, drives the operator back to a decoupled state. The inherent decoupling of the invention is achieved without requiring a sensing signal to tell the operator when it may become decoupled.

Manual operation is easy to perform with the decoupled operator. The motor driven temporarily mutually engaging elements of the drive assembly do not need to meet during a manual operation.

In particular forms of the invention a wide variety of drive elements can be employed that self-disengage following motor movement sufficient for switch operation from either open to closed or from closed to open. What is generally employed, for example, includes first and second drive elements (e.g., rotating or arcuately moving plates) that carry the temporarily mutually engaged parts where one of the drive elements is continuously linked to the motor shaft and the other of the drive elements is continuously linked to the operator output. The parts with temporary mutual engagement can, for example, be selected from any of the generally known types of mechanisms for force transfer followed by disengagement including a post on one drive element moving into and through cam elements with energy storage elements such as various types of spring-loaded elements (e.g., coil springs connected with pivoting fingers or leaf springs), compressible (e.g., hydraulic) fluid containing elements, or resilient (e.g., rubber) cushion type elements or some combination of such elements. Alternatively, mechanical temporary force transfer elements such as various forms of cam elements can be used with or without one or more energy storage elements. While none of these temporary force transfer elements may be basically novel in the mechanical arts, they are not known to have been applied in combinations with motor operators for power switches in the manner described.

The inherent decoupling of the motor drive can facilitate performance of a manual operation, even with a pole-top motor operator and switch installation. A worker does not need to perform a positive act to achieve decoupling and does not need to rely on operation of a control system (that might be inoperable due to loss of power) to achieve the decoupled state. A worker can tell decoupling has occurred by, for example, status indicators at ground level or by looking at the position of an operating member (e.g., a laterally extending bar or plate), that is continuously fixed to the operator output shaft, to see if the switch is open or closed. In normal use, there is no need for a worker to be immediately at the operator. Manual operation of an overhead switch from the ground is readily performed.

The operating member is all that is required to be used for a manual operation (or an operation by any power source other than the motor of the motor operator, which could be a second, perhaps portable, motor). Typically, such as in the case of an overhead or pole-top installation, a worker applies a hookstick or the like to that operating member (e.g., a handle with one or more features such as loops or apertures to capture the hookstick) to perform a manual switch operation with the already decoupled operator.

Also, the decoupled state indicated by the operating member allows a worker to operate (e.g., for testing) the motor without operating the switch itself by locking the operating member, such as by inserting a hookstick into a locking hole in the operating member to secure the operating member to a fixed part of the housing or support structure.

The lack of complexity of the required structure enhances its reliability and convenience in use. In some forms, after the switch travels to the open or closed position (whether or not the switch itself has spring-loaded contacts), the operating member of the motor operator hits its end-of-travel stops (e.g., posts fixed to the housing or support structure) and the force (torque) transfer is greater than the maximum force that can be held by the temporarily engaged parts of the drive elements; their relative motion continues to reach the inherently decoupled state. Further, a simple limit switch at each of the open and closed positions on one of the drive elements can be triggered by the other drive element to turn off power to the motor.

In a typical installation with preferred features, a worker at ground level can interact with the motor operator system in two ways. A control switch panel at ground level can (and preferably is) first switched from "Remote" to "Local" operation (or, perhaps, a "Manual Only" switch setting to prevent any power operation (as might occur following an outage)). Then the worker uses a hookstick (or "hot stick") to operate the lever or whatever other operating member is provided. Then "Local" operation of the motor (in the coupled or the decoupled state) can be performed as desired with controls switched to "Remote" as a further option.

While exhibiting characteristics particularly addressing the problem of difficult access described in the Background in connection with overhead switches, the apparatus of the invention also is generally applicable in combination with power switches in any location. Also, the power switches with which the operator of the invention is used may be those commonly available without requiring special switch features for getting the benefits of the invention.

These and other aspects of the present invention will be better understood from the following discussion and drawings of example embodiments.

DETAILED DESCRIPTION OF THE INVENTION

Figure 1:
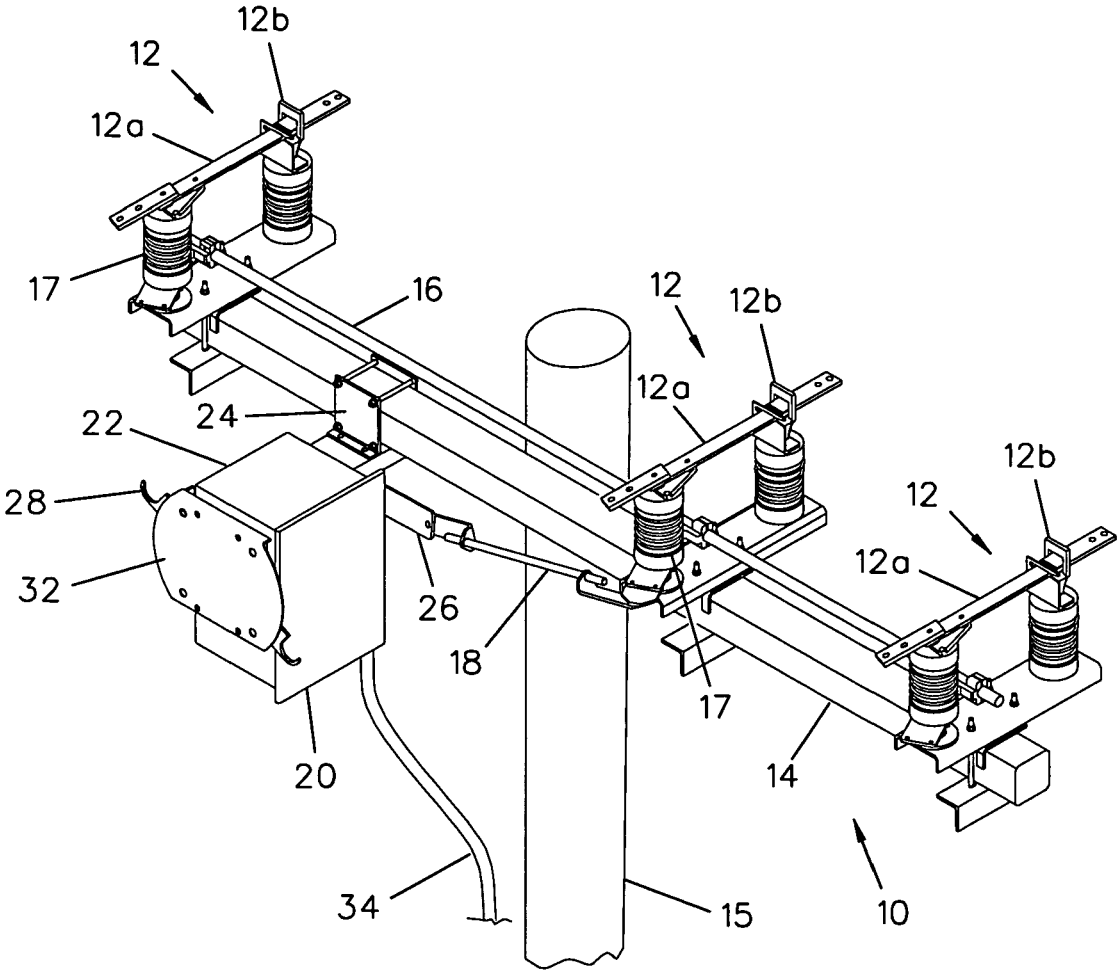
FIG. 1 is a perspective, partial, view of an overhead (pole-top) switch and motor operator installation.

FIG. 1 shows a typical pole-top installation of an electrical power switch 10 and a motor operator 20 in accordance with the invention. The illustrated switch 10 is a three-phase distribution switch with three switch poles 12 arranged for ganged operation on a cross-arm 14 on a utility pole 15. Each of the switch poles 12 includes a first switch contact 12*a* that is movable to a closed or open switch position in relation to a second switch contact 12*b* that is fixed. The three movable contacts 12*a* are each mechanically coupled to a switch operating rod 16 for operation together. The rod 16 is subject to linear movement effecting switch operation by rotation of one switch-pole movable insulator post 17 that has a mechanical linkage 18 to an output member of the motor operator 20. The illustrated switch 10 is sometimes referred to as a movable insulator type of switch because of the force transmitted through rotating insulators that support the movable contacts 12*a*. In the orientation shown in FIG. 1, the switch contacts 12*a* and 12*b* are closed.

The switch 10 may be of a known type of three-phase distribution switch. It could generally be any motor operatable switchgear, including distribution switches, transmission switches, reclosers, and the like.

In the view of FIG. 1 the motor operator 20 is shown having a housing 22 supported on the switch cross-arm 14 by a bracket 24. Extending from the back of the housing 22 there is an output member or lever 26 that is attached to the mechanical linkage 18 of the switch 10. At the front of the housing 22 there is shown an operating member or handle 28 that is accessible for manual operation. As will be discussed further below, the output member 26 and the operating member 28 are continuously mechanically linked to each other, and subject to mutual rotational motion, by an operator shaft 30 (FIG. 2) extending through the interior of the housing 22. An exterior plate 32 is fixed to the front of the housing 22 and has features that play a role (particularly in limiting rotational motion of the operating member) as further discussed below. FIG. 1 also shows by way of example a conduit 34 for electrical conductors connected with elements within the housing 22, such as for supply of power to a motor. Conduit 34 communicates to an electrical supply and control unit (not shown) that includes, for example, indicators of power switch status and motor position status that a worker can view and control switches that a worker can selectively alter for remotely or locally initiated power operation of the motor operator or manual operation.

Figure 2:
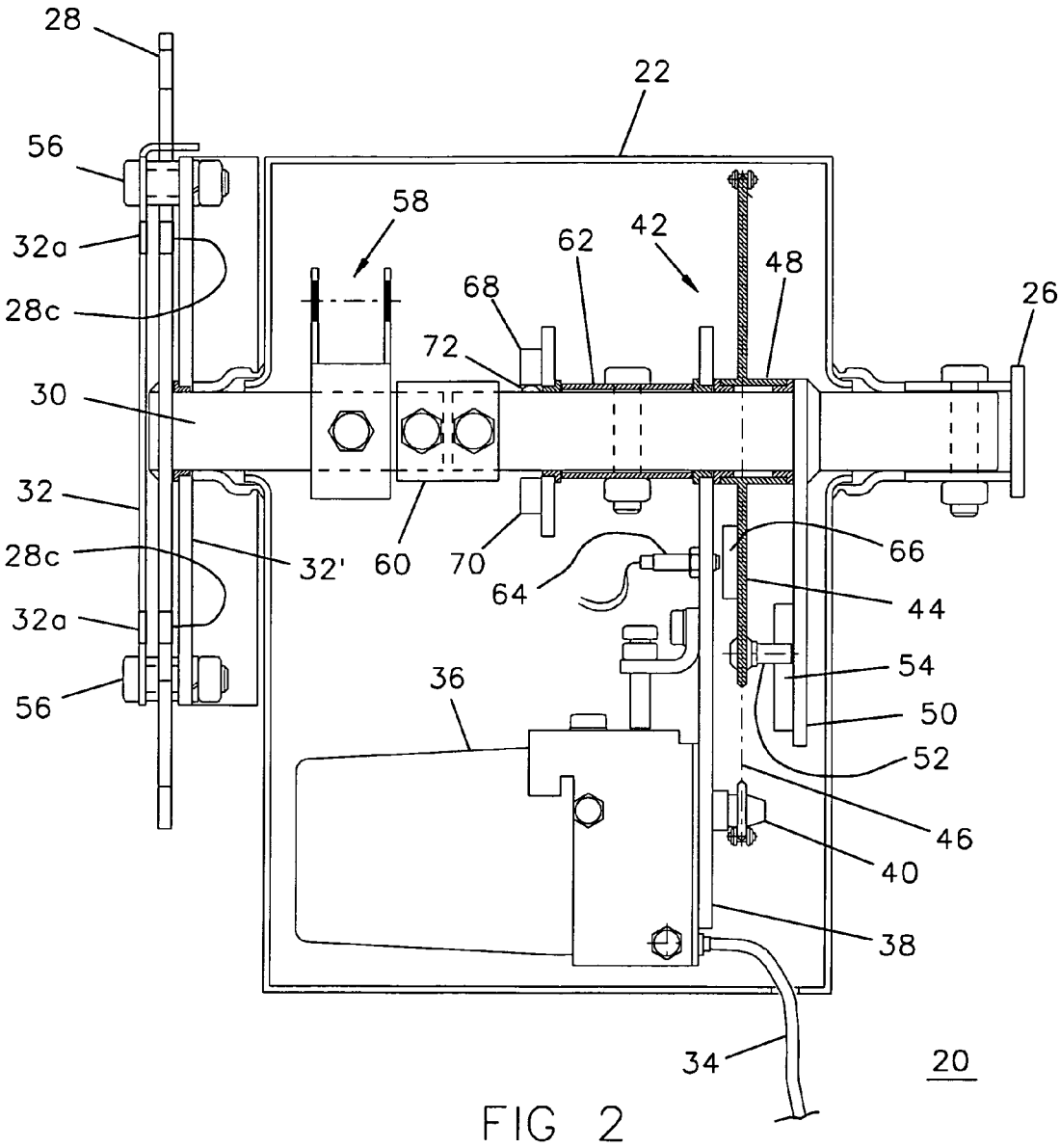
FIG. 2 is a side elevation view of a motor operator in accordance with one embodiment of the invention, with one side panel removed from the operator housing.

FIG. 2 shows internal elements of the motor operator 20. Compared to FIG. 1, FIG. 2 is substantially as if the right side of the housing 22 is removed. A motor 36 is supported on a mounting plate 38 joined with a wall of the housing 22. The motor 36 has a motor shaft 40 that rotates under power to the motor from the electrical conduit 34. A mechanical drive assembly 42 is coupled between the motor shaft 40 and the operator output member 26. The motor 36 is, for example, a reversible AC/DC motor.

In this example, the mechanical drive assembly 42 includes, without exclusion of other possible elements, a first drive plate 44 mechanically linked to the motor shaft 40. The first drive plate 44 and the motor shaft 40 each have sprockets on which a chain 46 runs. The first drive plate 44 is an example of a first drive element that is continuously mechanically linked to, and subject to movement with, the motor shaft 40. Rotation of the first drive plate 44 occurs about, but not joined with, the operator shaft 30. One or more bearings 48 between the plate 44 and the shaft 30 allow free relative motion of the two elements.

The mechanical drive assembly 42 of this example also includes a second drive plate 50 that is affixed to and subject to rotation with the operator shaft 30 (and, consequently, the output member 26 and the operating member 28). The second drive plate 50 is, in this example, one that extends radially from the shaft 30 without completely encircling the shaft. The second drive plate 50 is an example of a second drive element that is continuously mechanically linked to, and subject to movement with, the operator shaft 30.

Mechanical linkage between the first drive plate 44 and the second drive plate 50 occurs, during operation of the motor 36, but only temporarily. That is, for switch operation, it occurs for a sufficient time, and with a sufficient force, for the switch 10 to be operated by reason of rotation of the lever 26, but then ceases. This is because the two drive plates 44 and 50 have temporarily mutually engaging parts that, in FIG. 2, are merely generally indicated as a part 52 on plate 44 and a part 54 on plate 50. Examples of the parts 52 and 54 (which may each have one or more individual elements) will be further described below. In general, the temporarily mutually engaging parts 52 and 54 are such as to transmit torque for operation of the switch 10 and then to self-disengage (become decoupled) without any manual decoupling operation or need for reversal of the motor drive to reverse and decouple the parts 52 and 54.

Other elements shown in FIG. 2 include a second fixed plate 32' outside the housing 22 and joined with the first plate 32 in a parallel relation by stop bolts 56 that limit the travel of the operating member 28.

A shaft biasing mechanism 58 (e.g., of the springloaded or weighted overcenter type) is generally illustrated on the shaft 30 near the front (left face) of the housing 22. The mechanism 58 (not detailed in the drawing) can include a member fixed on the shaft 30 that works against a spring fastened between that member and a wall of the housing 22. The arrangement is such that rotation of the shaft 30 in either direction has to overcome some spring force and loose or floppy movement of the shaft mounted elements 26 and 28 is avoided.

For convenience in assembly, the shaft may be in two colinear pieces with a fixed coupling 60.

In the example of FIG. 2, the shaft 30 is principally supported by a bearing and support structure 62 secured to the housing 22.

Also, FIG. 2 shows that the motor mounting plate 38 has a position sensor or limit switch 64 with electrical conductors that are not fully shown but are carried through the electrical conduit 34 along with the leads to the motor 36. The position sensor 64 is such that it responds with an electrical signal when rotation of the first drive plate 44 places a magnet 66 immediately proximate the position sensor. The electrical signal is carried to a ground level control panel to indicate the positional status of the drive assembly 42. In FIG. 2, for a closed switch 10 position as shown in FIG. 1, the elements 64 and 66 are immediately adjacent to each other and power to the motor 36 would be off. A second limit switch (not shown) is on a more remote part of the plate 38 for responding to the magnet 66 in the open switch position of the drive.

The elements 64 and 66 (and the unshown counterpart) result in a signal that turns off power to the motor 36 and also serve to indicate that the motor has turned the drive plate 44 clockwise or counterclockwise to the proper angular position. In addition, the operator 20 has microswitches 68 and 70 on a fixed part of the operator 20 that generate a signal when a knob 72 on the shaft 30 forces contacts of either switch 68 or 70 to close. The signals from either switch 68 or 70 indicate the open or closed rotational status of the output member 26 and, therefore, of the power switch 10. Leads for switches 68 and 70 (not shown) would also be carried by the electrical conduit 34.

Figure 3:
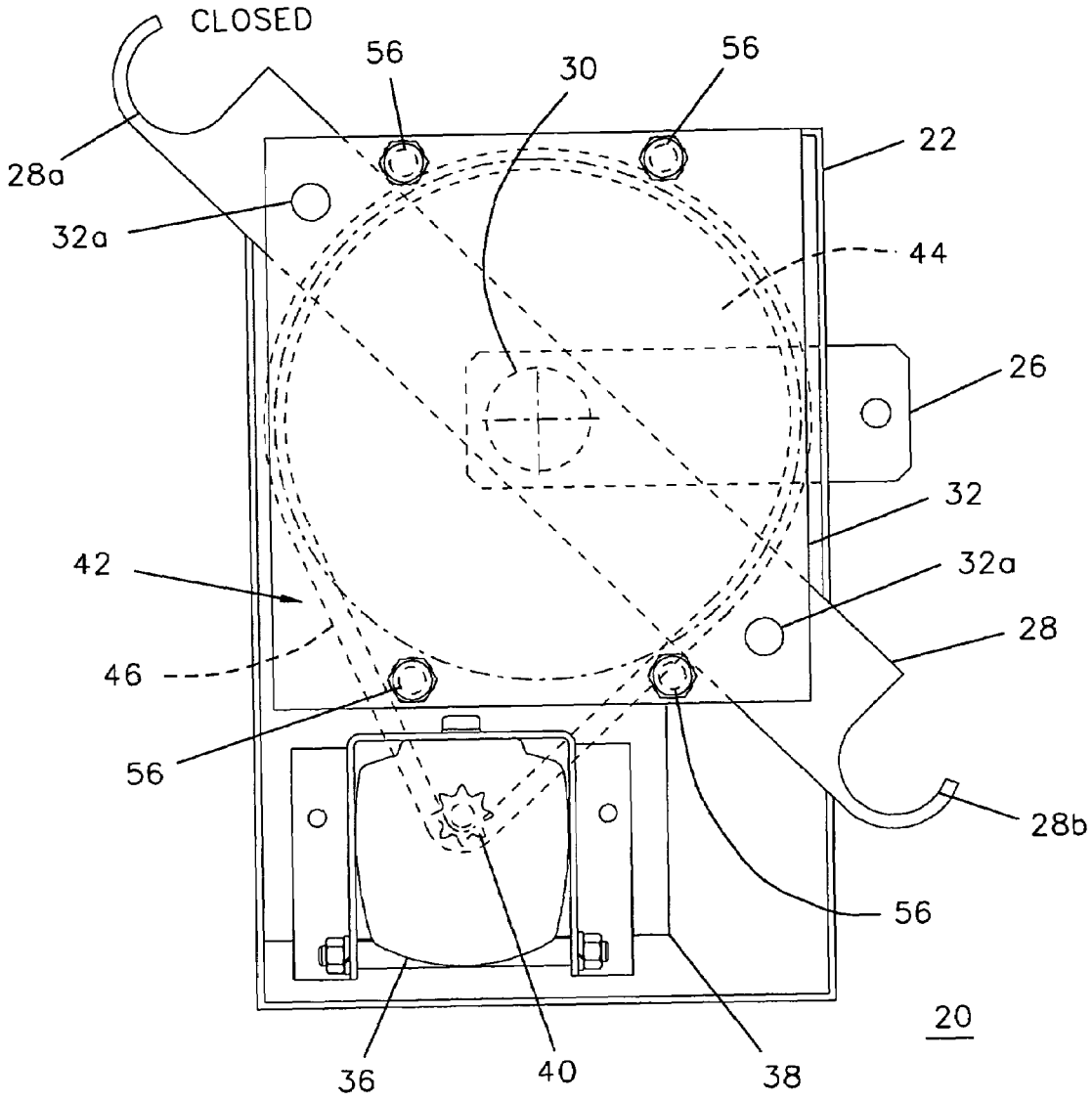
FIG. 3 is a front elevation view of the motor operator of FIG. 2 with some simplification of elements.

Further explanation of the structure and operation of the motor operator 20 will be given in connection with FIGS. 3 through 7. FIG. 3 is a front elevation view of the operator 20 of FIG. 2 with some simplification for easier discussion; the front of the housing 22 is assumed to be transparent and only a few of the elements behind the front plate 32 or the motor mounting plate 38 are shown (in dashed lines).

The mechanical drive assembly 42 is partly shown in FIG. 3 with the first drive plate 44 driven by the chain 46 off a sprocket on the motor shaft 40. Under motor operation, as previously explained (FIG. 2), the drive plates 44 and 50 transmit torque to the output member 26 by the brief engagement of the parts 52 and 54 on the respective plates. The illustrative example of FIGS. 2 and 3 represents an operator 20 for an airbreak switch 10 (FIG. 1) of which those in wide use most commonly operate between open and closed positions that are 90° apart. That means the operator output member 26 and the mechanical linkage 18 to the switch 10 can also be conveniently arranged for 90° rotation. This also means that 90° rotation of the operator shaft 30 produces the 90° rotation of the output lever 26 and necessarily also produces 90° rotation of the operating member 28. The principles of the operator 20 can, of course, be applied to operators for switches which require some angle of rotation of the output shaft different than 90°.

In this example operator 20, it is restriction of motion of the operating member 28 that determines the extent of the motion of the output lever 26. The handle 28 turns on the operator shaft 30 in substantially parallel relation to the fixed plates 32 and 32' (FIG. 1) that are joined by the stop bolts 56, four of which are shown in FIG. 3 at orthogonal locations on the plate 32. In FIGS. 2 and 3, the position of the handle 28 represents a switch closed position as in FIG. 1. The handle 28 has been turned clockwise until it has been stopped by the upper left and the lower right stop bolts 56. At that point the drive assembly 42 cannot turn the shaft 30 or the lever 26 any further. The torque applied by the motor 36 causes the part 52 on the first drive plate 44 to continue through and past the restraint applied by the part 54 on the now stopped second drive plate 50, resulting in the inherent decoupling of the motor 36 from the lever 26.

The decoupled motor operator 20 is now readily available for a manual operation, and the manual operation does not require any turning of the motor 36 or any engagement of parts 52 and 54 on the drive plates. In the embodiment shown, the handle 28 has portions extending beyond the plate 32. Each of these extended portions of the handle 28 has a feature, such as the open loop type features 28*a* and 28*b*, that can readily accept and retain a hookstick or the like for a manual operation. To go from a switch closed position as is taken as the example of FIGS. 2 and 3 (although the converse could also be the case) to a switch open position, a worker places a hookstick in the upper left handle loop 28*a* and turns it 90° counterclockwise where the handle 28 stops against the lower left and upper right stop bolts 56. After a manual switch opening, a corresponding manual switch closing can be performed with a hookstick in the right handle loop 28*b* and the handle 28 would be moved clockwise until stopped by the lower right and upper left stop bolts 56. In manually opening or closing a switch, the manual force simply moves the part 54 within the space between the locations of part 52 in its closed and open positions, without any engagement of the parts 52 and 54.

The geometry of the handle 28 can of course be varied from that shown. For example, it can be provided with hook retaining apertures rather than the open loops 28*a* and 28*b*. The open loops 28*a* and 28*b* contribute to worker safety. For example, if a worker has a hookstick in the handle loop 28*a* in the position shown in FIG. 3 and somehow the motor 36 is energized, the counterclockwise movement of the handle 28 by the motor will separate the handle 28 from the hookstick without having force transmitted through the hookstick to the worker.

FIGS. 2 and 3 also illustrate an option that can be another significant feature of the operator 20. When a worker has an interest in testing the motor 36 without turning the output lever 26 that operates the switch 10, it is convenient to lock the handle 28 in a fixed position. To do so in this example it is merely necessary to insert a hookstick or the like into a lockout hole 32*a* of the front plate 32 (either one shown) that is located over the position of a similar hole 28*c* (see FIG. 2) in the handle 28. With the operator lever 26 in a locked position by use of the holes 32*a* and 28*c*, the motor 36 can be driven under power and the temporarily engaging parts 52 and 54 on the drive plates still engage and disengage but without movement of the second drive plate 50. This can be a great convenience in contrast to prior operators that require either testing the motor with the switch being driven or more inconvenient measures taken to disconnect the motor.

FIGS. 4, 5, 6 and 7 show different stages in the operation of the example drive assembly 42 as seen by viewing the front of a drive plate such as the second drive plate 50 viewed from the left in FIG. 2. The drive plate 50 supports an assembly 154 corresponding to the part 54 of FIG. 2. FIGS. 4 through 7 also show the operator shaft 30, the position of the output lever 26, and the position of the part 52 fixed to the first drive plate 44 (FIG. 2). For convenience in describing FIGS. 4 through 7, the terminology adopted may be such that the assembly 154 is sometimes called the finger assembly, the plate 50 is called the finger plate, and the part 52 of the other drive plate 44 is called the motor drive pin.

The finger assembly 154 is but one example of a part 54 for temporary mutual engagement with a part 52, which is a fixed post in this example. The assembly 154 includes a pair of fingers or cam bars 170 and 172 that are joined at respective ends 170*a* and 172*a* to other elements and at pivot points 170*b* and 172*b* to the plate 50. Finger 170 has its end 170*a* coupled to a pair of coil springs 174 with fixed ends 174*a* attached to the plate 50. Finger 172 has its end 172*a* coupled to a pair of coil springs 176 with ends 176*a* away from the finger 172. For reasons having to do with conveniently available space, spring ends 176*a* are not fixed to the plate 50. Instead the ends 176*a* are attached to an end of a respective slider 178 which has a body that is free to slide on a securement 178*a* attached to the plate 50.

Figure 4:
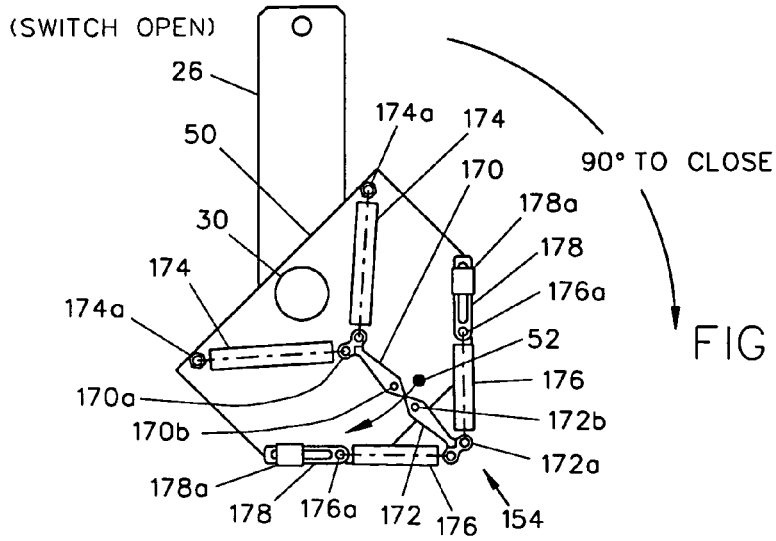
FIGS. 4, 5, 6, and 7 are elevation views of part of the drive assembly of the motor operator of FIGS. 2 and 3 at successive stages of operation.

In FIG. 4, the orientation of the elements is for a fully open switch position with the lever 26 straight up from the shaft 30. At this position, the finger assembly 154 and the motor drive pin 52 are totally disengaged and stationary. The fingers 170 and 172 are mutually aligned without stress on any of the springs 174 and 176 or the sliders 178.

Figure 5:
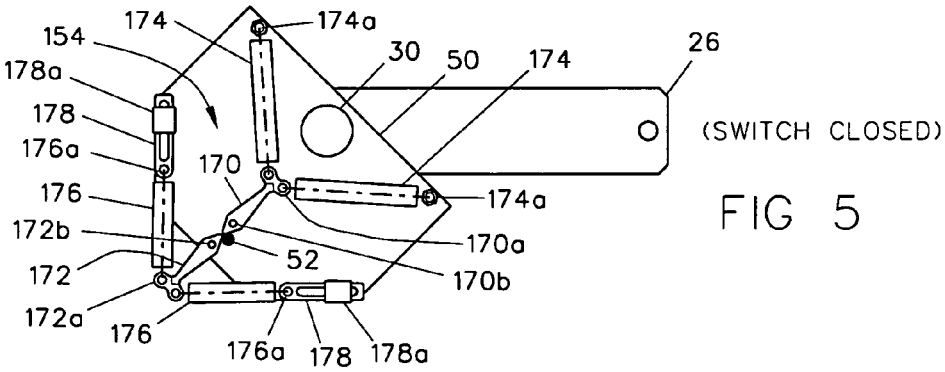

FIG. 5 shows the elements after a clockwise movement of the drive pin 52 but before decoupling and while the drive pin is still under power. The finger plate 50 and the lever 26 are however stopped by reason of the previously described handle stop bolts 56. Under the torque exerted by the drive pin 52 on the fingers 170 and 172 the drive plate 50 has been driven to the position shown. The pin 52 is in contact with the fingers 170 and 172 but the other elements 174, 176 and 178 of the finger assembly are not yet forced out of their prior symmetrical positions.

Figure 6:
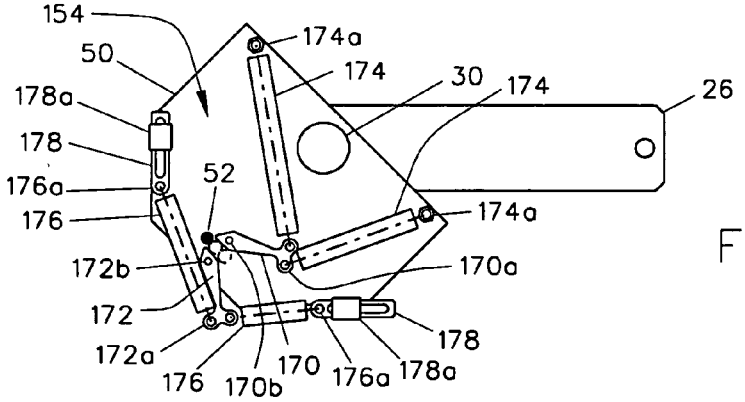

With the continuing operation of the motor 36, while the plate 50 is at a stop, the pin 52 is forced by the motor 36 through the fingers 170 and 172 by pivotal motion of the fingers about the pivot points 170*b* and 172*b*. FIG. 6 shows the positions during the passage of the pin 52 through the fingers 170 and 172, before it is completed and the motor stops. In FIG. 6, the elements are shown with the fingers 170 and 172 pivoting and, also, one spring 174 is stretched due to the transmitted force and one of the springs 176 is compressed, with movement of its attached slider 178 in its securement 178*a*. Some flexing of the other springs and slider may also occur during the force transfer.

Figure 7:
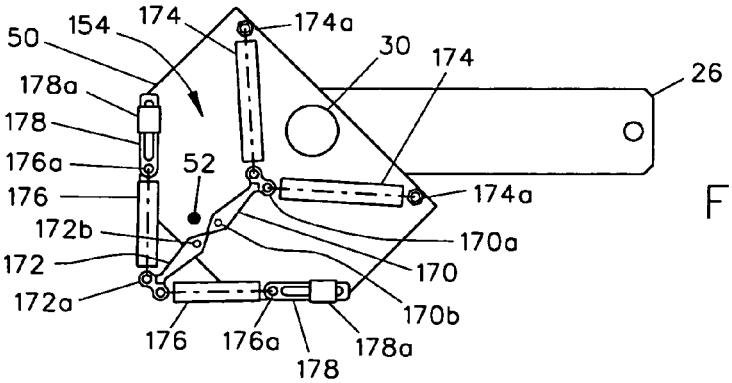

As soon as the pin 52 has moved far enough to release from the fingers 170 and 172, the elements 170, 172, 174, 176 and 178 all relax again into the neutral position shown in FIG. 7. Now the switch is not only closed, as it was in FIGS. 5 and 6, the operator 20 is also decoupled from the drive and a manual operation from closed to open can be performed without running the motor 36 (or having any of the elements 170, 172, 174, 176 and 178 engage the pin 52 because the pin is outside the course of travel of the finger assembly 154). A reverse operation of the motor can also be performed.

It is to be clearly understood that the fixed post 52 on the first drive plate 44 and the finger assembly 154 on the second drive plate 50 are merely examples of parts that can mutually engage with sufficient torque transmission for switch operation and then disengage. This example is of the nature of a non-eccentric cam (the post 52) working against spring-loaded fingers (fingers 170 and 172 with related elements 174, 176 and 178). Generally such an arrangement 154 can be considered within a class of known mechanisms sometimes referred to as swinging-arm cam followers.

In other terminology sometimes used in the mechanical arts, the arrangement of pin 52 and finger assembly 154, with their respective drive plates 44 and 50, can be considered as, or similar to, a spring-loaded, positive-tooth clutch where the "teeth" represented by the pin 52 and fingers 170 and 172 make positive engagement with torque transmission and disengage after a predetermined amount of torque is encountered. In general, the parts 52 and 54 (or 154) can be located on drive plates 44 and 50 in reverse of the locations shown; that is, part 52 can be on plate 50 instead of plate 44 and part 54 (or 154) can be on plate 44 instead of plate 50.

More generally, the parts 52 and 54 can be any camming elements with or without energy storage members such as springs (e.g., coiled or leaf), compressible cylinders (e.g., hydraulic), or resilient cushion-type elements. Within the broad fields of mechanical power transmissions and mechanical linkages are a wide variety of known mechanisms that may be adapted for the purposes of a motor operator in accordance with the invention. Applicant's invention resides principally in novel combinations of such mechanisms with other motor operator elements.

From the above description, it can be understood a motor operator is provided with a drive assembly 42 including, at least in part, means for transmitting switch operating force from the motor 36 to the output member 26 that results in a decoupled state of the motor and the output member, even absent any reversal of the motor (e.g., either automatically by an electrical controls system or manually initiated) and before any manual operation is performed. The means for transmitting the force can include, at least in part, the first and second drive plates 44 and 50 that are rotatable (although a corresponding relation of longitudinally moving elements is also mechanically suitable). The means for transmitting the force also includes temporarily mutually engaging parts 52 and 54 on the drive plates 44 and 50 such as those described in connection with FIGS. 4–7 or other forms of camming elements with or without any one or more energy storage elements, springs, hydraulic elements, resilient elements and slider elements (the terms mentioned are not necessarily mutually exclusive), not all of which are illustrated herein.

Further, it is seen that the operating member 28 and the output member 26 are in a combination with the drive assembly 42 that includes stop means represented, for example, by the stop bolts 56, for stopping motion of the operating member 28 and the output member 26 upon completion of a switch operation while the motor continues to operate to reach the decoupled state (e.g., the stop means being effective in FIGS. 5, 6, and 7). It can be seen that alternative or additional stop means can be located otherwise on the shaft 30 or its joined parts 26 and 28, including a part of the switch or switch operating mechanism subject to rotation with them.

Additionally, the example includes means on the operating member 28 (e.g., features 28*a* or 28*b*) for locating an alternative operating force means (power or manual; such as via a hookstick (not shown)).

There is also a means for selectively preventing motion of the output member, e.g., locking holes 32*a* and 28*c*, that can be held with a manually inserted hookstick for allowing operation of the motor without switch operation. Such a means can occur anywhere between the rotating shaft and the fixed structure.

In various parts of the description and claims where parts of elements or combinations of elements are described, none of the descriptions are to be taken as implying restriction to only the named elements when such a restriction is not required by other language. Accordingly, terms such as "having", "including" or "comprising" are generally to be taken as intended to be open to other aspects or elements (whether or not spelled out) unless otherwise stated to be limited.

While the invention requires only fairly simple mechanical elements, one could accompany them with various aspects of automated control if desired.

Consequently, it is apparent numerous variations in accordance with the general teachings given above are suitable for practice of the invention.

What is claimed is:

1. A motor operator, for an electrical power switch, comprising:

a motor having a motor shaft;

an output member attachable to a switch operating mechanism;

a mechanical drive assembly coupled between the motor shaft and the output member, the drive assembly including at least a first drive element continuously mechanically linked to, and subject to movement with, the motor shaft and at least a second drive element continuously mechanically linked with the output member;

the first and second drive elements being arranged to have temporarily mutually engaging parts, with transfer of motive force to the output member sufficient for switch operation, during operation of the motor;

the first and second drive elements and their temporarily mutual engaging parts also being arranged to self-disengage from each other following motor movement of the output member.

2. The motor operator of claim 1 further comprising:

an operating member continuously mechanically linked with the output member, the operating member being arranged to receive motive force from a source independent of the motor to drive the output member without requiring movement of the motor shaft or the first drive element.

3. The motor operator of claim 2 where:

the operating member at least in part includes a handle secured with a shaft fixed with the output member with one or more features for temporary location of a hand tool for manual operation of the output member while the first and second drive elements are disengaged.

4. The motor operator of claim 3 where:

the operating member and a stationary part of the motor operator are arranged to be manually lockable together to allow power operation of the motor without movement of the output member.

5. The motor operator of claim, 1 where:

the first and second drive elements include as the temporarily mutually engaging parts at least first and second engagement parts that are joined to respective ones of the first and second drive elements and at least one of the first and second engagement parts includes an energy storage member;

the first and second drive elements have temporary mutual engagement with transfer of motive force that is released following motor operation to effect positive disengagement of the first and second drive elements.

6. The motor operator of claim 5 where:

the first drive element includes a first drive plate rotatable on a bearing about a first shaft portion and mechanically linked to rotate in direct relation to rotation of the motor shaft and having, as a first engagement part, a fixed post extending therefrom;

the second drive element includes a second drive plate on a second shaft portion mechanically linked to the output member and having, as a second engagement part, at least one cam element coupled to an energy storage member.

7. The motor operator of claim 6 where:

the operating member is arranged to hit a positive mechanical stop, after motor operation has resulted in sufficient force transfer to the output member, that also stops movement of the second drive plate and the first drive plate proceeds with the post thereon passing and disengaging from the second engagement part on the second drive plate.

8. The motor operator of claim 7 where:

the first and second shaft portions are coaxial;

the first drive plate is chain driven off of the motor shaft and runs freely in relation to the first shaft portion; and the second drive plate is fixed to the second shaft portion.

9. An electrical power switch and a motor operator in combination, comprising:

a mechanical actuating linkage between the motor operator and the switch;

the motor operator having a motor with a motor shaft that is coupled to the mechanical actuating linkage through a drive assembly with a first drive element continuously mechanically linked to the motor shaft and a second drive element continuously mechanically linked to the mechanical actuating linkage of the operator and the switch;

the first and second drive elements of the drive assembly including temporarily mutually engaging parts that, in operation, transfer sufficient torque for switch operation between open and closed positions followed by inherent decoupling of the first and second drive elements;

a manual operating member continuously linked with the mechanical actuating linkage and arranged to be accessible for manually operating the switch from ground level without turning the motor; and the manual operating member and a stationary part of the motor operator being accessible for manually locking together to allow power operation of the motor without movement of the mechanical actuating linkage.

10. The combination of claim 9 where:

the first and second drive elements include as the temporarily mutually engaging parts at least first and second engagement parts that are joined to respective ones of the first and second drive elements and at least one of the first and second engagement parts includes an energy storage member;

the first and second drive elements have temporary mutual engagement with transfer of motive force that is released following switch operation to effect positive disengagement of the first and second drive elements;

the first drive element includes a first drive plate rotatable on a bearing about a first shaft portion and mechanically linked to rotate in direct relation to rotation of the motor shaft and having, as a first engagement part, a fixed post extending therefrom;

the second drive element includes a second drive plate on a second shaft portion mechanically linked to the output member and having, as a second engagement part, at least one cam element coupled to an energy storage member;

the operating member is arranged to hit a positive mechanical stop, after motor operation has resulted in sufficient force transfer to the output member, that also stops movement of the second drive plate and the first drive plate proceeds with the post thereon passing and disengaging from the second engagement part on the second drive plate.

11. An overhead electrical power switch and a motor operator in a combination installed together at an elevated location and comprising:

a mechanical actuating linkage between the motor operator and one or more movable contacts of the switch at the elevated location;

the motor operator including a motor, an output member joined with the mechanical actuating linkage, a drive assembly between the motor and the output member, and an operating member that extends to an exteriorly accessible position of the motor operator;

the motor is one capable of being reversibly driven to operate the switch, through the drive assembly, the output member and the mechanical actuating linkage, from a closed position to an open position and from an open position to a closed position;

the output member and the operating member being in a fixed relation for movement together;

the drive assembly including, at least in part, means for transmitting switch operating force from the motor to the output member that results in a decoupled state of the motor and the output member following each switch operation, even absent any reversal of the motor and before any manual operation; and the operating member comprises means for locating an operating force means independent of the motor of the motor operator to operate the switch through the output member without operation of the motor of the motor operator.

12. The combination of claim 11 where:

the means for transmitting switch operating force of the drive assembly includes, at least in part, a first drive plate arranged for rotation upon motor operation and a second drive plate joined for rotational motion with the output member and the operating member.

13. The combination of claim 12 where:

the means for transmitting switch operating force further includes, at least in part, temporarily mutually engaging parts on the first and second drive plates including camming elements with or without any one or more energy storage elements, springs, hydraulic elements, resilient elements, and slider elements.

14. The combination of claim 13 where:

the temporarily mutually engaging parts include, at least in part, a fixed post on one of the first and second drive plates and a spring-loaded finger on the other of the drive plates.

15. The combination of claim 11 where:

the operating member and the output member are in a combination with the drive assembly that includes, at least in part, stop means for stopping motion of the output member upon completion of a switch operation while the motor continues to operate to reach the decoupled state of the motor and the output member.

16. The combination of claim 15 where:

the stop means includes, at least in part, fixed stop elements on a stationary part of the motor operator that the operating member hits against upon a switch operation.

17. The combination of claim 11 where:

the means for location of an operating force means on the operating member includes, at least in part, features for manual application of a tool that can extend from a lower level to the elevated location and the operating force means includes, at least in part, a worker manipulating the tool.

18. The combination of claim 11 where:

the motor operator further includes means for selectively preventing motion of the output member during operation of the motor.

19. The combination of claim 18 where:

the means for selectively preventing motion of the output member includes, at least in part, one or more features of the operating member and of a stationary part of the motor operator into which a tool can be selectively inserted to prevent motion of the operating member and, consequently, of the output member, to allow operation of the motor without switch operation.

20. The combination of claim 11 further comprising:

an electrical supply and control unit at a lower location electrically interconnected with the motor operator and including, in part, elements indicating an open or closed condition of the switch in the decoupled state of the motor operator drive assembly; and one or more manually alterable control switches for selectively setting the electrical supply of the unit in relation to the motor operator to a desired mode including locally initiated power operation and remotely initiated power operation.

21. A motor operator operating an electric switch in a combination comprising:

a motor for motorized operation of the switch;

a handle for manual operation of the switch, the handle having a constant direct connection with an operating mechanism of the switch;

the motor being coupled to the operating mechanism of the switch by a momentary spring coupling connection arranged to deliver sufficient torque from the motor for switch operation;

the spring coupling connection also being arranged to decouple the motor from the switch operating mechanism following a completed switch operation when mechanical stops are reached in a fully open or a fully closed position of the switch, thereby allowing manual operation of the switch by the handle without turning the motor.

22. The combination of claim 21 where:

the mechanical stops at completion of a switch operation are one or more elements of a fixed part of the total combination that are struck by one or more elements of any of the handle, the switch operating mechanism, and the direct connection therebetween.

23. The combination of claim 21 further comprising:

means for selectively temporarily securing in a fixed position the handle, the switch operating mechanism, and the direct connection therebetween to allow motor operation without switch operation.

* * * * *